US006361348B1

(12) United States Patent
Hall et al.

(10) Patent No.: US 6,361,348 B1
(45) Date of Patent: Mar. 26, 2002

(54) RIGHT ANGLE, SNAP ON COAXIAL ELECTRICAL CONNECTOR

(75) Inventors: John Wesley Hall, Harrisburg; James Michael Raudenbush, Halifax; George Wilson Michael, III, Harrisburg; John Mark Myer, Millersville, all of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/761,016

(22) Filed: Jan. 15, 2001

(51) Int. Cl.[7] ..... H01R 13/627
(52) U.S. Cl. ..... 439/352; 439/578
(58) Field of Search ..... 439/352, 582, 439/578, 675

(56) References Cited

U.S. PATENT DOCUMENTS

| | | | | |
|---|---|---|---|---|
| 4,008,941 A | | 2/1977 | Smith | |
| 4,017,139 A | | 4/1977 | Nelson | |
| 4,374,606 A | | 2/1983 | Lathrop | |
| 4,412,717 A | | 11/1983 | Monroe | |
| 4,655,534 A | * | 4/1987 | Stursa | 439/582 |
| 5,062,808 A | | 11/1991 | Hosler, Sr. | |
| 5,316,494 A | | 5/1994 | Flanagan et al. | |
| 5,482,477 A | | 1/1996 | Michael | |
| 5,547,400 A | | 8/1996 | Wright | |
| 5,561,269 A | | 10/1996 | Robertson et al. | |
| 5,595,499 A | | 1/1997 | Zander et al. | |
| 5,695,357 A | | 12/1997 | Wright | |
| 5,741,159 A | | 4/1998 | Wright | |
| 5,842,872 A | | 12/1998 | Hosler, Sr. et al. | |
| 6,036,540 A | | 3/2000 | Beloritsky | |

OTHER PUBLICATIONS

AMP Customer Drawing C–414948—1996.
AMP Customer Drawing C–415134—1995.

* cited by examiner

*Primary Examiner*—Tulsidas Patel
*Assistant Examiner*—Phuong KT Dinh

(57) ABSTRACT

A right angle coaxial connector assembly 2 includes a shell subassembly 10 and a collar subassembly 70 in addition to a center pin contact 50 and a dielectric sleeve 60. The collar subassembly 70 is spring loaded relative to the shell subassembly 10. The collar assembly 70 is formed by two mating hermaphroditic housings 72. The shell subassembly includes a diecast rear shell 30 and a screw machined front shell 12 that includes flexible snap lock fingers 16 that are held in locking engagement with a mating connector by the collar subassembly 70.

20 Claims, 7 Drawing Sheets

RIGHT ANGLE, SNAP ON COAXIAL ELECTRICAL CONNECTOR

BACKGROUND OF THE INVENTION

1. Field of the Invention

This invention is related to coaxial electrical connectors. More particularly, this connector is related to right angle coaxial connectors, either plugs or sockets. Furthermore this connector is a snap lock connector in which the two connectors are locked together when mated and cannot be disengaged or unmated by application of a simple tensile force to one of the mated connectors.

2. Description of the Prior Art

Coaxial or RF plug and jack electrical connectors typically include means for connecting center conductors in separate coaxial cables and for connecting the outer shield or braid in the two cables. In some cases, the center conductor in one of the cables is connected directly to a socket terminal in the other coaxial connector, but often a pin is attached or crimped to the center conductor in the cable. The center contact and the braid contact in each connector or terminal are typically separated by a cylindrical dielectric surrounding the center contact. The outer contact is typically attached to the braid or shield of a coaxial cable by crimping a ferrule to the braid after the end of the cable has been prepared or stripped.

Once plug and jack coaxial connectors have been attached to sections of a coaxial cable, a number of conventional means have been employed to mate the plug connector to the jack connector. One connector may employ an outer ring with internal threads which can then be screwed to the mating connector with external mating threads. BNC style coaxial connectors employ a laterally facing pin or post on one connector that is captured within a slot on the mating connector. However, both of these coaxial connector configurations require that mating connectors must be mounted by rotating one connector relative to its mating connector. This approach may be satisfactory for many traditional applications, such as field assembly of two coaxial cables, for example connecting two cables in a commercial or residential building. However, when the coaxial cables are used in a larger component or subassembly, such as a harness in an automobile or motor vehicle, that is assembled in a large scale production environment, screwing the two coaxial connectors together is undesirable.

One alternative to coaxial connectors that are mated by screwing one connector to another, is to employ a snap-on or quick connect, quick disconnect configuration in which one coaxial connector is simply pushed into mating engagement with the other coaxial connector without mutual rotation. These prior art snap-on connectors typically include a plurality of screw machined or die cast spring fingers in a cylindrical configuration. Adjacent spring fingers are separated by slots and include mating ridges adjacent their free ends. The individual spring fingers can be radially when pushed onto a mating connector having a diameter that differs from the normal neutral position of the spring fingers. The spring fingers can be deflected inwardly or outwardly, depending on whether they are inserted into a bore in cylindrical sleeve or over the exterior of a cylindrical barrel. When the quick connect, quick disconnect, snap-on connectors are fully mated, the spring fingers are received within a groove or recess on the mating connector, so that the spring fingers return to their neutral position. Examples of coaxial connectors of this general type are shown in U.S. Pat. Nos. 4,017,139; 4,412,717; 5,842,872; and 6,036,540. Although conventional coaxial connectors of this type do not require rotational movement for mating, the disconnect force is typically approximately the same as the connection or mating force. Thus quick connect, quick disconnect coaxial connectors cannot be locked when mated, so that a significantly greater force is required to unmate or disconnect the coaxial connectors than was required to mate them. The fact that these prior art connectors cannot be locked together can cause problems when they are used in automotive applications or in harness assemblies for use in similar applications, because the connectors can be inadvertently dislodged during assembly or pulled apart when a force is applied to one of the coaxial cables, possibly as part of a later assembly operation. Vibration due to movement of the automobile or similar apparatus can also cause disengagement of the mated coaxial connectors.

The use of a locking molded collar assembly formed by mating hermaphroditic housings is shown in commonly assigned U.S. patent application Ser. No. 09/738,675 entitled Snap On Plug Coaxial Connector. That patent shows an in-line coaxial connector assembly instead of a right angle coaxial connector. An example of a right angle coaxial connector with spring finger for engaging a mating connector is shown in U.S. Pat. No. 6,036,540. However, that connector does not provide a means for locking the two connectors together.

SUMMARY OF THE INVENTION

Some applications for coaxial connectors require the use of a right angle connector. Space limitations can dictate the use of a right angle connector instead of a more common in line coaxial assembly. Automotive assemblies are one example of an application in which other limitations can require the use of the more complicated right angle connector. A right angle coaxial connector, either a plug or socket, is physically more difficult to manufacture and to terminate. The instant invention provides not only a right angle coaxial connector, but also provides one in which two coaxial connectors can be locked together so that they cannot be disengaged or unmated by simply pulling on one of the connectors. Additional force or manipulation is required to disconnect the connectors. This requirement also complicates the manufacture of these connectors, and the instant invention provides a relatively simple manufacturing approach to a connector assembly including both a shell and a shiftable collar. The shell has two parts. In the preferred embodiment a rear shell is diecast and a front shell is screw machined. Since the front shell contains flexible snap lock fingers, damage to the fingers can be minimized by screw machining the front shell.

This invention, which achieves these and other objectives, comprises a right angle coaxial electrical connector assembly that includes a center contact; a dielectric surrounding the center contact; a shell subassembly surrounding the center contact and the dielectric, and a collar subassembly. The shell subassembly is positioned between the dielectric and the collar subassembly. The collar subassembly is in turn spring loaded and shiftable relative to the shell subassembly;

The shell subassembly includes a front shell attached to a rear shell. The rear shell has a first passage extending at a right angle relative to a second intersecting passage. The center contact and the dielectric are positioned within the first passage. The second passage is dimensioned to receive at least a portion of a stripped end of a coaxial cable to which the connector is to be attached.

The collar subassembly is generally coaxial relative to the first passage and the front shell includes at least one radially flexible spring finger extending beyond the rear shell. This collar subassembly is shiftable between a first or neutral position and a second position relative to the shell subassembly. The collar subassembly engages the spring finger in the neutral position to prevent radially outward deflection of the spring finger. The spring finger is spaced from the collar subassembly in the second position so that the spring finger can shift radially outward when the collar subassembly is in the second position. This connector can thus be locked to a mating connector and cannot be unmated until the collar is shifted longitudinally relative to the shell.

DETAILED DESCRIPTION OF THE PREFERRED EMBODIMENT

Figure 1:
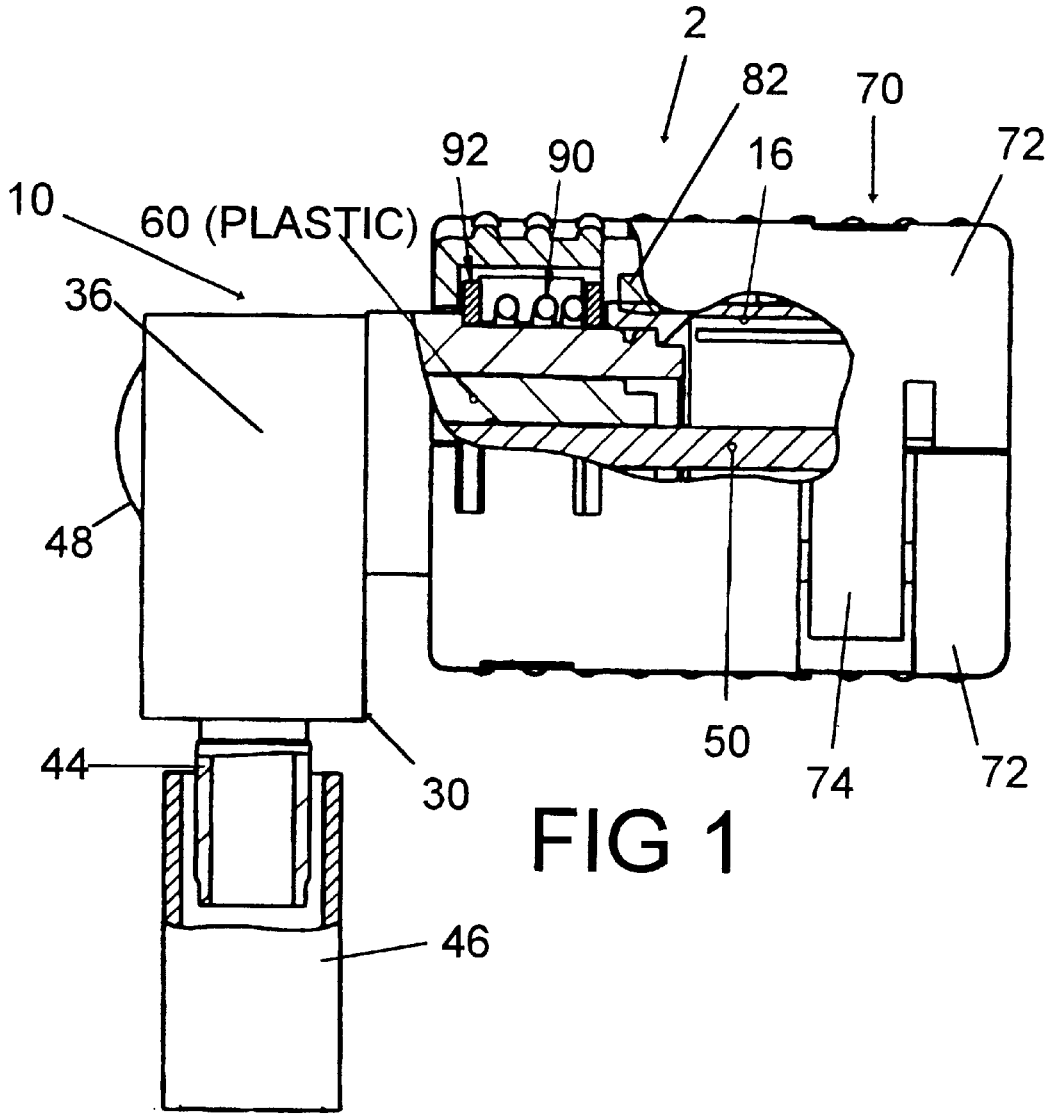
FIG. 1 is a side view of a right angle coaxial electrical connector or plug assembly in accordance with this invention in which a portion of the assembly is shown in section.
Figure 2:
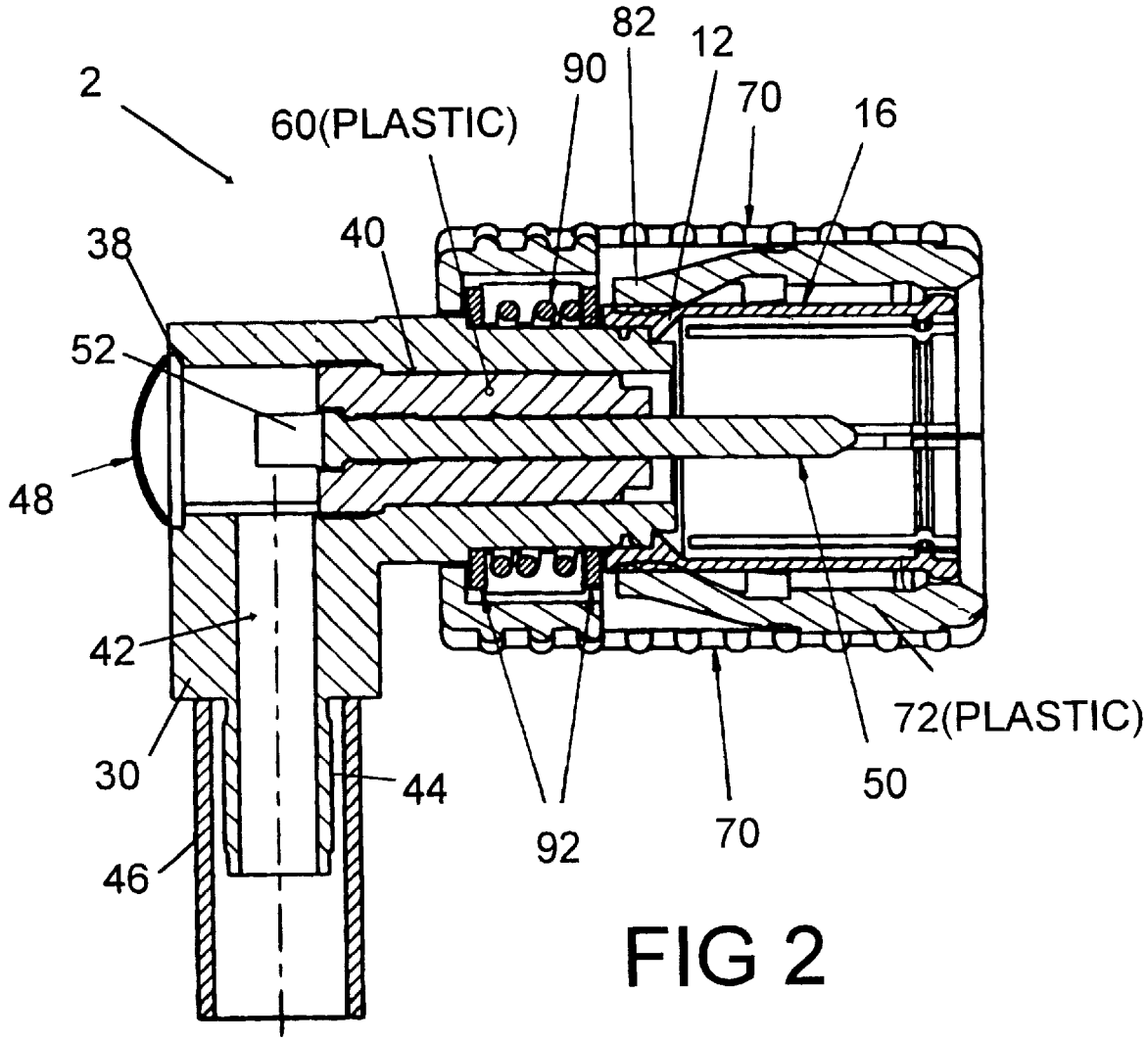
FIG. 2 is a longitudinal section view taken through a central plane of the connector or plug assembly shown in FIG. 1.
Figure 4:
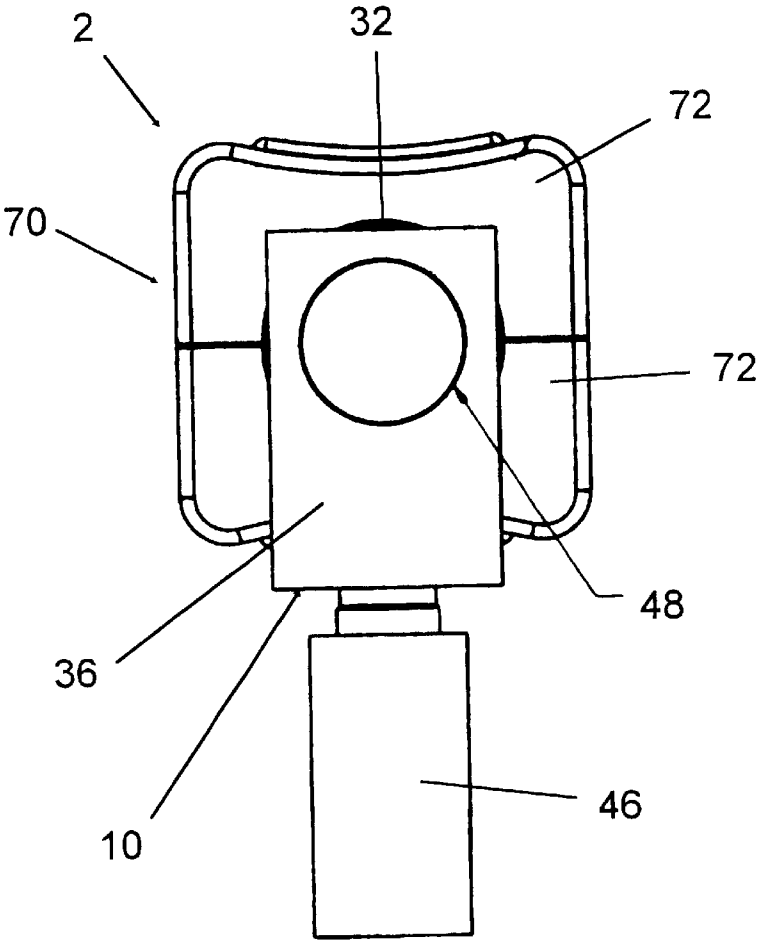
FIG. 4 is a view of the rear of the connector or plug assembly of FIGS. 1–3.
Figure 3:
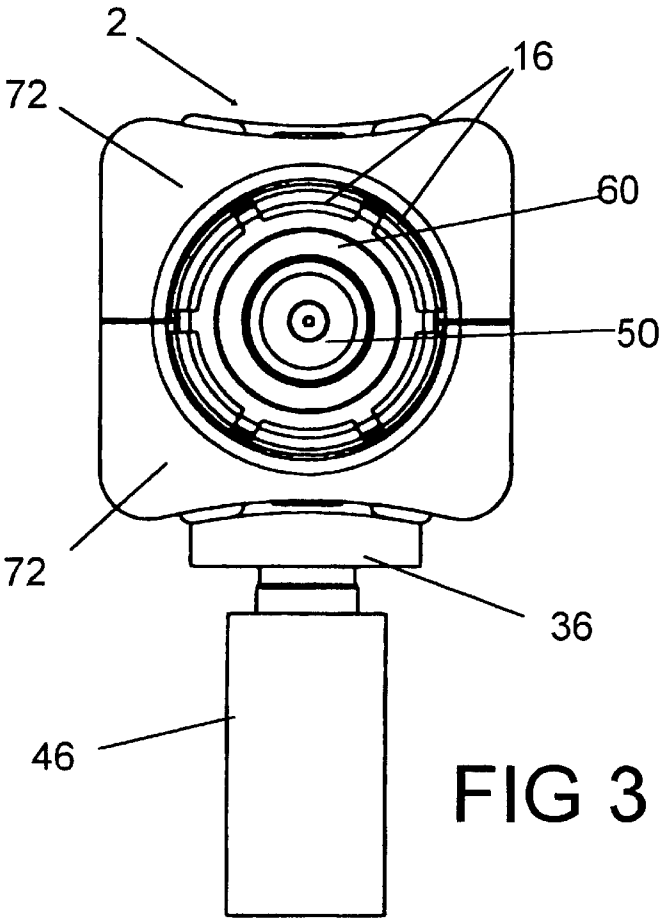
FIG. 3 is a view of the mating face of the connector or plug assembly of FIGS. 1 and 2 showing the cavity in which a mating coaxial socket connector is inserted to mate with the plug assembly.
Figure 6:
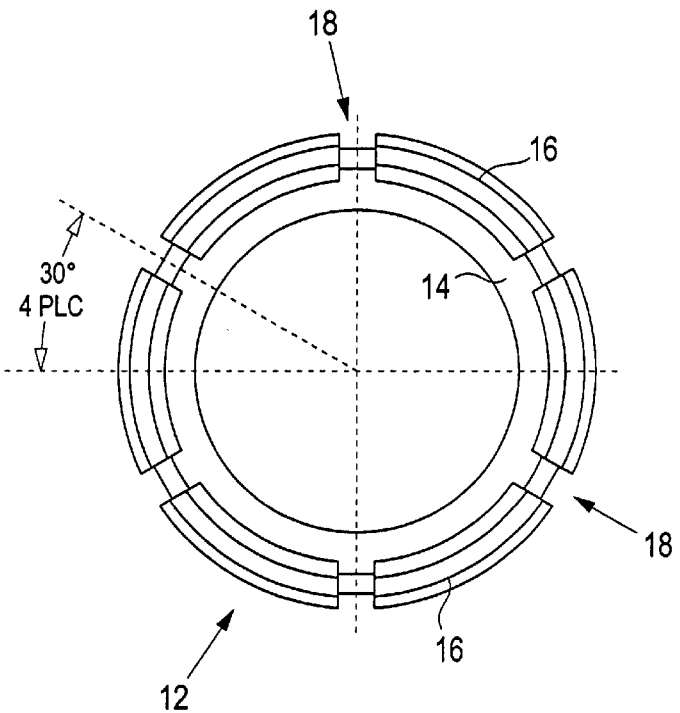
FIG. 6 is an end view of the front shell shown in FIG. 5.
Figure 5:
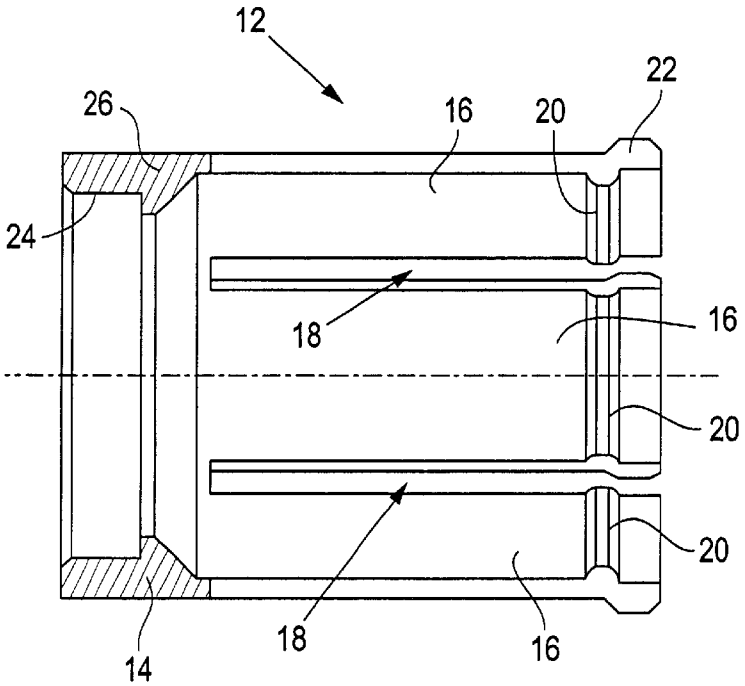
FIG. 5 is a longitudinal section view of the front shell that employs deflectable spring fingers to snap onto a mating coaxial socket to insure that the two coaxial connectors remain in a mated configuration.
Figure 7:
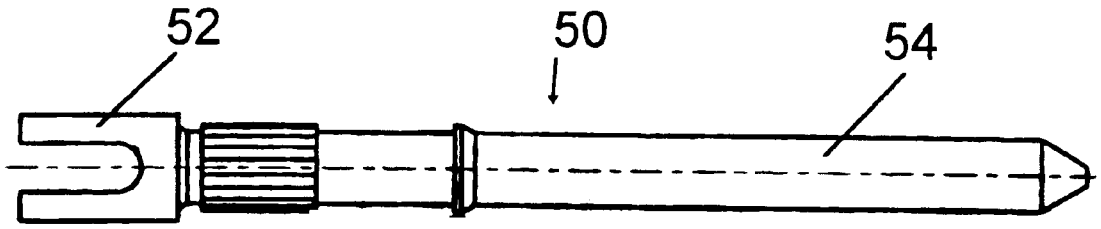
FIG. 7 is a side view of a center pin contact of the type used in the right angle snap on, conaxial connector shown in FIGS. 1 and 2.
Figure 8:
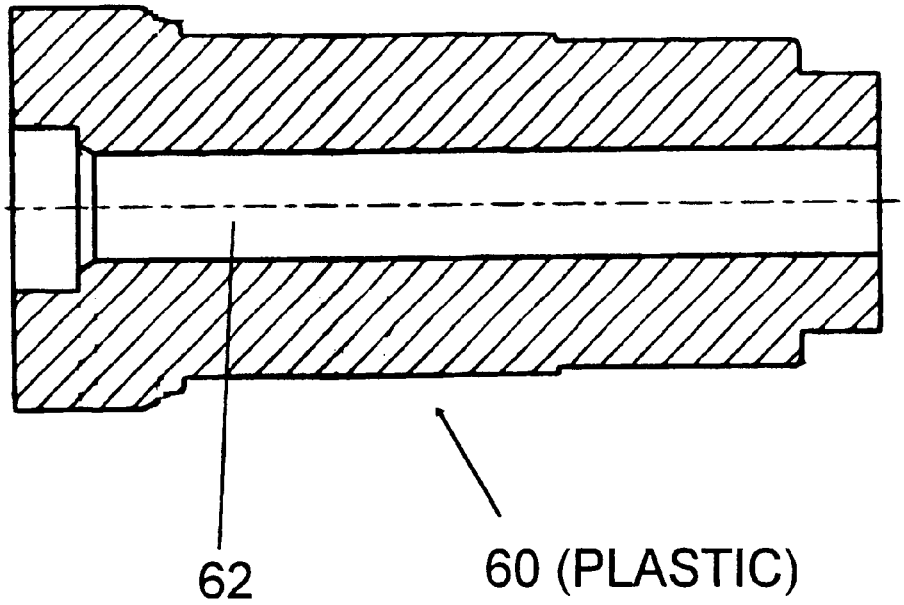
FIG. 8 is a longitudinal section view of a dielectric that is surrounded by the shell and includes a central bore for receiving the pin contact shown in FIG. 7.

The representative or preferred embodiment of the right angle coaxial electrical connector assembly 2 depicted herein comprises a snap on, right angle, mini-UHF coaxial plug assembly. This plug assembly 2 includes a shell subassembly 10, a collar subassembly 70, a center or pin contact 50 and a dielectric 60 separating the center contact 50 from the shell subassembly 10. These components and subassemblies are shown in FIGS. 1 and 2, which shows the assembled relationship of these parts. Another configuration could however employ a socket or female center contact instead of the male or pin center contact 50 depicted in this representative embodiment.

The shell subassembly 10 includes a front shell 12 that is secured to the forwardmost portion of a rear shell 30. The cylindrical dielectric 60 is positioned within a cylindrical passage in the rear shell 30, and the pin contact 50 is positioned within a central bore 62 in the dielectric 60. The rear shell 30 is crimped or inwardly deformed to secure the dielectric 60 in place. The collar subassembly 70, including two identical or hermaphroditic molded housing components 72, is positioned in surrounding relationship to the front shell 12 and a portion of the rear shell 30. A coil spring 90 is trapped between the collar subassembly 70 and the shell subassembly 12 holds the collar subassembly 70 in a first or neutral position relative to the shell subassembly 12 as shown in FIGS. 1 and 2. The collar subassembly 70 can however shift relative to the shell subassembly 12 in either a forward or aft direction relative to this neutral position, resulting in compression of the spring 90. Compressed coil spring 90 will then cause the collar subassembly and/or the shell subassembly 12 to return to their neutral position when the displacement force is removed.

The front shell 12 and the rear shell 30 are secured together by mounting the rearmost portion of the front shell 12 in surrounding relationship to the forwardmost portion of the rear shell 34. In the preferred embodiment, an interference fit sufficient to withstand a push off force of approximately 155 newtons is employed, although the front shell 12 could be staked to the rear shell 34. In the preferred embodiment, the front shell is screw machined from a material, such as phos bronze, which has a ductility or flexibility that is greater than the material used to fabricate the rear shell 30. In the preferred embodiment, the rear shell comprises a zinc diecast member.

Front shell 12 is a cylindrical member having six deflectable cantilever spring fingers 16 extending from a continuous cylindrical band 14, which comprises the rearmost portion of the front shell 12. Adjacent spring fingers 16 are separated by slots 18, and the distal or forward ends of the individual spring fingers 16 are each radially outwardly deflectable. Each deflectable spring finger 16 includes an inwardly directed, rounded protrusion or rib 20 spaced a short distance from the free end of the spring finger. This rib or protrusion 20 will engage a companion surface on a mating connector, not shown, to lock the plug assembly 2 to the mating connector to prevent inadvertent disengagement. An outer rib or protrusion 22 is located between the longitudinal position of the inner rib 20 and the end of the same or corresponding spring finger 16. This outer rib 22 will normally bear against an opposed surface on the collar subassembly 70, when the collar subassembly 70 and the shell subassembly 10 are in their relatively neutral position as shown in FIGS. 1 and 2.

The cylindrical band 14 at the rear of the front shell 10 has an inner bearing surface 24 that engages the exterior of the forwardmost portion of the rear shell 30 in the assembled configuration. An inwardly extending bearing rim 26 abuts a front edge of the rear shell 30 to longitudinally position the two shell members in the assembled configuration of the shell subassembly 10.

The rear shell 30 is a one piece zinc diecast body having a front toroidal or cylindrical body section 32 and a generally rectangular body section 36. A first passage 40 extends through the toroidal body section 32 and is intersected by a second passage 42 that extends through the rectangular body section 36, substantially perpendicular to the first passage 40. The first passage 40 is dimensioned to receive the pin or center contact 50 and its surrounding dielectric sleeve 60, and the second passage 42 is dimensioned to receive a stripped end of a coaxial cable 100. The dielectric 60 is held in the first passage by staking the surrounding metal into engagement with the delectric 60 in a conventional fashion. The pin contact 50 is held in the dielectric 60 by a knurled section on the center or pin contact 50 with a mating section 54 of the pin extending beyond the dielectric 60. The rectangular body section 36 also includes a rear opening 38 that is in alignment with the first passage 40 extending through the toroidal body section 32. This opening is large enough to permit insertion of the dielectric sleeve 60, with the pin contact 50 located in the dielectric bore 62, through the opening 38 into the first passage 40. When the pin contact 50 is properly positioned in the shell subassembly 10, a center conductor mounting segment 52 is located so that an exposed coaxial cable center conductor 102 can be positioned in the U-shaped surface of this segment 52, so that the center conductor 102 can be crimped or soldered into electrical engagement with the cable center conductor 102. A cap 48 can then be secured in the opening 38 to enclose the striped and terminated coaxial cable end. A cylindrical ferrule extension 44 extends from the bottom of the rectangular rear body section 36 in a position in which a ferrule 46 can be inserted over the extension 44. The ferrule 46 and the cylindrical extension 44 comprise means for terminating the braid or shield 104 on the stripped end of the coaxial cable 100. The second passage 42 extending through the toroidal passage does however provide room for the coaxial cable center conductor 102 and the cable dielectric separating the braid 104 from the center conductor 102.

The coil spring 90 is assembled in surrounding relation to the toroidal or cylindrical shell body section 32 before the front shell 12 is positioned in surrounding relationship to the forwardmost portion of the rear shell 30. Washers 92 are positioned on each end of the coil spring 90, and inner edges the washers 92 engage a protruding rib at the rear of the toroidal shall body section 32 and the back edge of the front shell 12 that surrounds the forwardmost portion of the rear shell 30. The coil spring 90 is thus held on the exterior of the rear shell 30, but the coil spring 90 is free to axially deflect and the washers 92 are free to shift relative to the outer surface of the rear shell 30.

Figure 9:
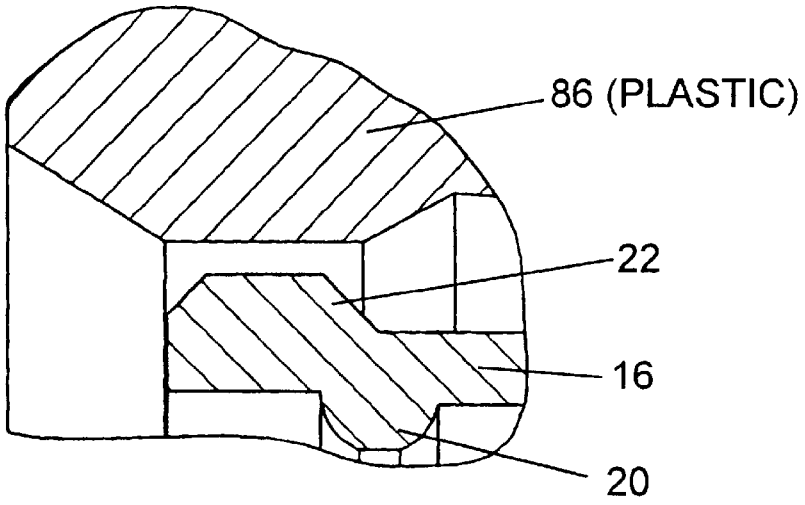
FIG. 9 is a detail section view of the mating end of the front shell, showing the manner in which the collar prevent outward deflection of the spring fingers in a first or neutral position.
Figure 10:
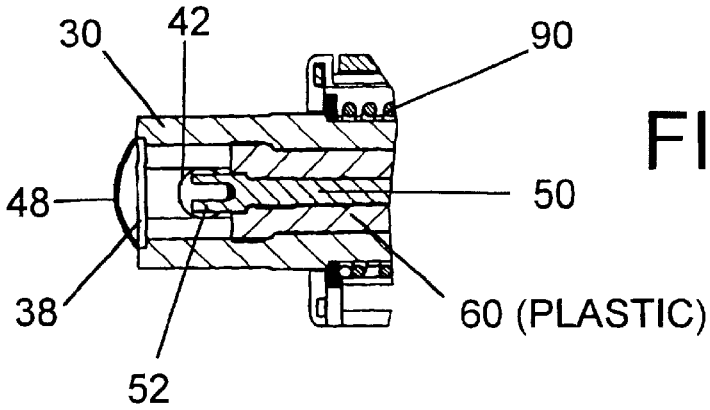
FIG. 10 is a section view of rear shell with the center or pin contact disposed in a position in which a center coaxial cable conductor can be position for termination to the pin contact.
Figure 12:
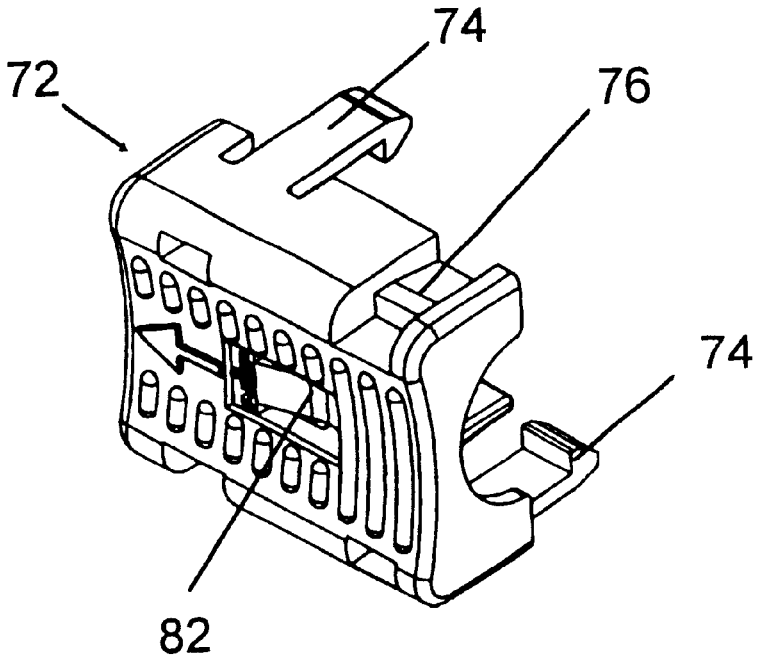
FIG. 12 is a three dimensional view of the exterior of one of the two collar housings that form the collar subassembly.
Figure 13:
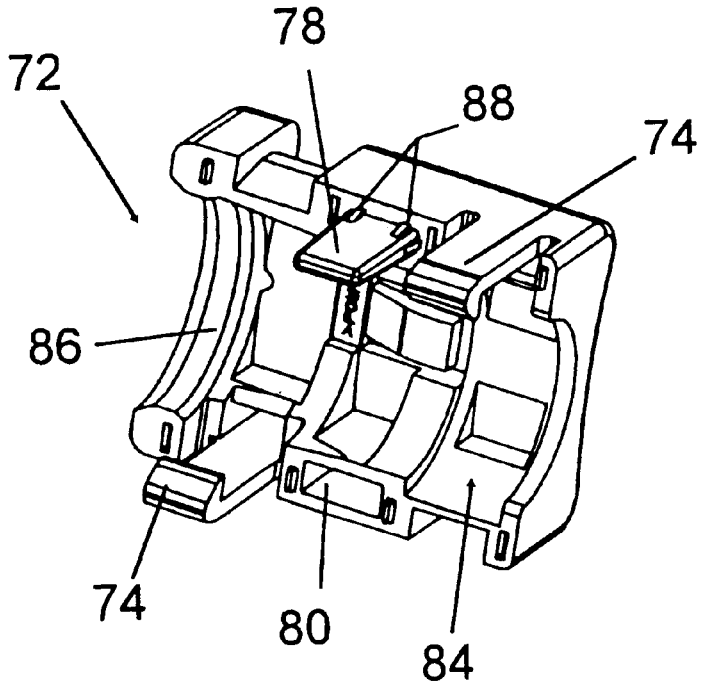
FIG. 13 is a three dimensional view of the interior of one of the collar housings shown in FIG. 12.

The two molded collar housings 72, that together form the preferred embodiment of the collar subassembly 70 can be snapped together in surrounding relationship to the shell subassembly 10 and to the coil spring 90 and washers 92 previously assembled on the exterior of the shell subassembly 10. In this preferred embodiment, the two housings are molded from a plastic, such as acetal, and these two housings 72 are identical or hermaphroditic. No other hardware is needed to hold the two housings 72 in position, but the invention is not limited to a collar subassembly 72 that is formed of two hermaphroditic molded housings. As shown in FIGS. 12 and 13, each housing 72 has a pair of snap latches 74 that will engaged opposed snap shoulders 76 on the other housing when the two housings 72 are snapped together in partial surrounding relationship to the shell subassembly. An alignment projection 78 on each housing 72 will be received within an opposed alignment pocket 80 with protruding surfaces 88 on the alignment projection wedged into the alignment pocket 80. An inwardly projecting anti-vibration finger 82 extends inwardly into engagement with the shell subassembly 12 to prevent rattle or vibration of the collar subassembly 70 relative to the shell subassembly 10. Although FIGS. 1 and 2 show a partial overlap between the antivibration finger 82 and the front shell 12, the antivibration finger 82 will in actuality be flexed outwardly, and this force will hold the collar housings 72 in position so that they will not move or vibrate in actual use. Each housing component 72 also includes a curved inwardly recessed spring cavity 84 that is dimensioned to fit on either side of the coil spring 90 with the washers engaging surfaces forming the end of this cavity 84. Thus when the collar subassembly 70 moves longitudinally relative to the shell subassembly 10, in either a fore or and aft direction relative to the neutral position shown in FIGS. 1 and 2, the collar subassembly will exert a force on the coil spring 90, opposite to the direction of an opposed force exerted by the shell subassembly 10 to compress the coil spring 90 thus generating a restoring force tending to keep the collar and shell in the neutral position. The collar housings 72 each include an inwardly protruding latch stop boss 86 that, as shown in FIG. 9, will be directly opposite the outer ribs 22 on the deflectable spring fingers 16 when the assembly is in the neutral position. Latch stop boss 86 thus prevents outwardly deflection of the spring fingers 16 in the neutral position. However, axial movement of the latch stop boss 86 will provide clearance for outward deflection of the spring fingers 16 so that the plug connector assembly 2 can be mated or unmated from a mating coaxial connector, not shown. However when the collar returns to the neutral position of FIG. 9, the inwardly directed rib 20 will engage an opposed surface on the mating coaxial connector to lock the two connectors together. Axial movement of the collar 70 will then be necessary to disengage or unmate the two connectors. In other words, the relative movement between the shell subassembly 12 and the collar subassembly 70 allows the two connectors to be locked together in a snap on configuration so that they cannot be unmated by simply attempting to pull them apart or by the application of an inadvertent tensile force.

Figure 11:
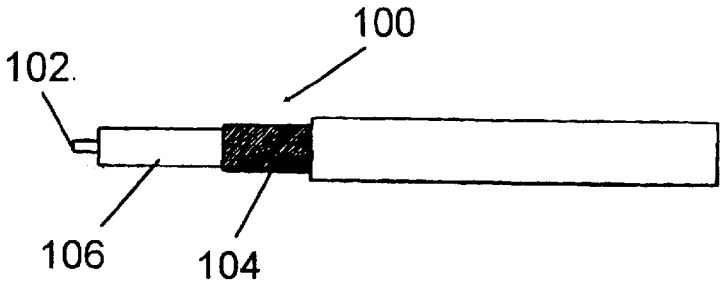
FIG. 11 is a view of a stripped end of a coaxial cable that has been prepared for termination to the coaxial connector assembly of FIGS. 1–10.

Fabrication and assembly of the right angle snap on coaxial plug connector 2 and its mating to a mating socket connector has been discussed with respect to the description of the individual parts. To recapulate, the front shell is screw machined form a material, such as phos bronze, and the rear shell 30 is diecast as a single piece from a material, such as zinc. The coil spring 90 and washers 92 are then assembled around the rear shell 30 before the front shell 12 is secured in surrounding relationship to the front part of the rear shell 30. At this point, the collar housings 72 are snapped together around the front shell 12, trapping the coil spring 90 in the spring cavity 84 so that the collar housings engage the outer periphery of the washers 92 so that relative movement will compress the springs. The center pin contact 50, which has been previously inserted into the dielectric 60 is now inserted through the opening 38 in the rear shell 30 into the first passage 40, and the rear shell 30 is staked to secure the pin 50 and the dielectric 60 in position. To terminate the coaxial cable 100 to the connector 2, one end of the cable 100 is stripped as shown in FIG. 11 to expose the center conductor 102 and a portion of the braid 104. The ferrule 46 is then slipped over the coaxial cable 100, which is then inserted through the second passage 42 until the center conductor is positioned in the U-shaped pin segment 52 and the braid 104 is deployed in surrounding relationship to the ferrule extension 44. The ferrule 46 is then slipped over the braid to terminate the braid between the extension 44 and the ferrule 46. The center conductor 102 is then soldered or crimped to the U-shaped segment 52 to terminate the center pin contact 50 to the cable center conductor 102. The cap 48 is then snapped into place closing the opening 38. The plug connector assembly 2 is then ready to be mated with a mating socket connector. During mating, the collar subassembly 70 is moved relative to the shell subassembly 10 to allow the spring fingers 16 to deflect outwardly during mating. In practice the operator will grip the collar subassembly 70 and the shell subassembly 10 will move rearwardly relative to the collar subassembly 70 to free the spring fingers 16 for outwardly deflection. When the two connectors are fully mated, the operator will release the collar subassembly 70, which will snap back to the neutral position due to the force exerted by the compressed spring 90. To unmate or disengage the two connectors, the operator will normally pull back on the collar subassembly 70 freeing the latching fingers 16 and permitting disengagement from the mating connector so that the two connectors can be unmated.

The preferred embodiment of this invention employs a two part shell subassembly in which one part is diecast and the other part is screw machined. It should be understood however that many of the same advantages of this configuration can be achieved by diecasting the front shell. Other means for attaching the front shell to the rear shell would also be apparent to one of ordinary skill in the art. It would also be possible to replace the molded collar housings with metal housings or to fabricate the collar as a single part. However, each of these alternatives, while not departing from the scope of the invention as claimed herein, are believed to exhibit certain disadvantages over the functionality of the connector assembly comprising the preferred embodiment shown herein. Other means for spring loading the collar subassembly relative to the shell subassembly could also be employed. The following claims therefore define the scope of the invention and are not limited by the representative embodiment depicted herein.

We claim:

1. A right angle coaxial electrical connector including a center contact; a dielectric surrounding the center contact; a shell subassembly surrounding the center contact and the dielectric; and a collar subassembly, the shell subassembly being positioned between the dielectric and the collar subassembly, the collar subassembly being spring loaded and shiftable relative to the shell subassembly, wherein;

the shell subassembly comprises a front shell attached to a rear shell, the rear shell including a first passage extending at a right angle relative to a second intersecting passage, the center contact and the dielectric being positioned within the first passage, with the second passage being dimensioned to receive at least a portion of a stripped end of a coaxial cable to which the connector is to be attached;

and wherein the collar subassembly is generally coaxial relative to the first passage and the front shell includes at least one radially flexible spring finger extending beyond the rear shell, and wherein the collar subassembly is shiftable between a first and a second position relative to the shell subassembly, the collar subassembly engaging the spring finger in the first position to prevent radially outward deflection of the spring finger, with spring finger being spaced from the collar subassembly in the second position so that the spring finger can shift radially outward when the collar subassembly is in the second position.

2. The right angle coaxial electrical connector of claim 1 wherein the front shell includes a plurality of deflectable spring fingers.

3. The right angle coaxial electrical connector of claim 1 wherein the front shell has greater flexibility than the rear shell.

4. The right angle coaxial electrical connector of claim 3 wherein the front shell surrounds a forwardmost portion of the rear shell.

5. The right angle coaxial electrical connector of claim 4 wherein the front shell is secured to the rear shell, the front shell including a continuous cylindrical band from which multiple spring fingers extend, the cylindrical band surrounding and being secured to the forwardmost portion of the rear shell.

6. The right angle coaxial electrical connector of claim 3 wherein the rear shell comprises a diecast member and the front shell comprises a screw machined member.

7. The right angle coaxial electrical connector of claim 1 wherein a coil spring surrounds a portion of the rear shell, the coil spring being compressed as the collar subassembly moves relative to the shell subassembly.

8. The right angle coaxial electrical connector of claim 1 wherein the collar subassembly comprises two housing components assembled in surrounding relationship to the front shell and to at least a portion of the rear shell.

9. The right angle coaxial electrical connector of claim 1 wherein the collar subassembly comprises a molded housing.

10. The right angle coaxial electrical connector of claim 9 wherein the collar subassembly comprises two matable molded housing components with a coil spring fitting between the two housing components and the rear shell.

11. The right angle coaxial electrical connector of claim 1 wherein the rear shell includes a rear opening comprising means for providing access to a rear portion of the center contact for securing a center conductor in a coaxial cable to the center contact.

12. The right angle coaxial electrical connector of claim 1 wherein a ferrule surrounding a portion of the rear shell comprises means for terminating an outer conductor in a coaxial cable to the shell subassembly.

13. The right angle coaxial electrical connector of claim 1 wherein the rear shell comprises a one piece body having a toroidal body section through which the first passage extends and a rectangular body section through which the second passage extends.

14. The right angle coaxial electrical connector of claim 13 wherein the rectangular body section includes an opening aligned with the first passage in the toroidal body section.

15. The right angle coaxial electrical connector of claim 14 wherein the rear shell body comprises a zinc diecast member.

16. A coaxial electrical connector assembly including a center contact; a dielectric surrounding the center contact; a shell surrounding the center contact and the dielectric, and a collar surrounding at least a portion of the shell, the collar being spring loaded relative to the shell and being shiftable relative to the shell between a first and a second position; wherein the shell comprises a front shell attached to a rear shell, the rear shell comprising a one-piece diecast member and the front shell comprising a one-piece screw machined member having a plurality of spring members outwardly deflectable when the collar is in the first position relative to the shell and restrained by the collar against outward deflection when the collar is in the second position relative to the shell.

17. The coaxial electrical connector assembly of claim 16 wherein a portion of the front shell surrounds a portion of the rear shell.

18. The coaxial electrical connector assembly of claim 16 wherein the rear shell includes means for receiving a coaxial cable extending at a right angle relative to the center contact.

19. The coaxial electrical assembly of claim 18 wherein a coil spring is positioned between the rear shell and the collar, the collar comprises a two piece, clambshell member assembled in surrounding relationship to the spring.

20. A method of fabricating a right angle coaxial connector assembly comprising the steps of:

die casting a first shell member;

screw machining a second shell member having radially outwardly deflectable spring fingers;

positioning an axially biasing spring around the first shell member;

assembling the second shell member to the first shell member with a rearwardmost portion of the second shell member surrounding a forwardmost portion of the first shell member, securing the second shell member to the first shell member and trapping the axially biasing spring around the first shell member, and positioning two semicylindrical collar housing members around the first and second shell members so that the collar housing members are spring biased by the axially biasing spring relative to the first and second shell members.

* * * * *